US011287153B2

(12) United States Patent
Delgoshaei

(10) Patent No.: US 11,287,153 B2
(45) Date of Patent: Mar. 29, 2022

(54) METHOD AND APPARATUS FOR RISK REDUCTION DURING REFRIGERANT LEAK

(71) Applicant: Lennox Industries Inc., Richardson, TX (US)

(72) Inventor: Payam Delgoshaei, Addison, TX (US)

(73) Assignee: Lennox Industries Inc., Richardson, TX (US)

( * ) Notice: Subject to any disclaimer, the term of this patent is extended or adjusted under 35 U.S.C. 154(b) by 90 days.

(21) Appl. No.: 16/700,104

(22) Filed: Dec. 2, 2019

(65) Prior Publication Data

US 2021/0164678 A1 Jun. 3, 2021

(51) Int. Cl.
*F24F 11/00* (2018.01)
*F24F 11/36* (2018.01)
*F25B 29/00* (2006.01)

(52) U.S. Cl.
CPC ..... *F24F 11/36* (2018.01); *F25B 29/003* (2013.01); *F25B 2500/222* (2013.01)

(58) Field of Classification Search
CPC .. F24F 11/36; F25B 2500/22; F25B 2500/222
See application file for complete search history.

(56) References Cited

U.S. PATENT DOCUMENTS 4,437,868 A 3/1984 Kuhlman
5,351,037 A 9/1994 Martell et al.
6,772,598 B1 8/2004 Rinehart
10,113,783 B2 10/2018 Takagi
2002/0178738 A1 12/2002 Taira et al.
2004/0016241 A1 1/2004 Street et al.
2004/0016253 A1 1/2004 Street et al.
2004/0239498 A1* 12/2004 Miller ..... G08B 25/016 340/539.13
2008/0060367 A1 3/2008 Zima et al.
(Continued)

FOREIGN PATENT DOCUMENTS

CN 209181072 U 7/2019
EP 0719995 A2 7/1996
(Continued)

OTHER PUBLICATIONS

JPH07159010 Translation (Year: 2003).

*Primary Examiner* — Jonathan Bradford
(74) *Attorney, Agent, or Firm* — Shackelford, Bowen, McKinley & Norton, LLP

(57) ABSTRACT

A method of monitoring a refrigerant leak. The method includes monitoring, by a first controller, operation of a first HVAC system for conditioning air within a first level of a residence, monitoring, by a second controller, operation of a second HVAC system for conditioning air within a second level of the residence and determining, using a plurality of leak detectors, whether refrigerant within the first HVAC system is leaking. Responsive to a positive determination in the determining step, receiving, by the first controller, a refrigerant leak warning signal, forwarding, by the first controller to the second controller, the refrigerant leak warning signal. Responsive to receiving the refrigerant leak warning signal from the first controller, activating, by the second controller, a variable-speed circulation fan of the second HVAC system.

20 Claims, 3 Drawing Sheets

(56) References Cited

U.S. PATENT DOCUMENTS

| | | | | |
|---|---|---|---|---|
| 2010/0082162 | A1* | 4/2010 | Mundy | F24F 11/70 700/277 |
| 2010/0315247 | A1* | 12/2010 | Tseng | F21V 23/0442 340/628 |
| 2011/0113802 | A1* | 5/2011 | Wakamoto | F25B 13/00 62/196.1 |
| 2013/0213068 | A1 | 8/2013 | Goel et al. | |
| 2016/0109170 | A1* | 4/2016 | Schrey | F25B 49/005 62/115 |
| 2016/0178229 | A1 | 6/2016 | Chen et al. | |
| 2017/0284718 | A1* | 10/2017 | Suzuki | F24F 11/89 |
| 2018/0259235 | A1* | 9/2018 | Delgoshaei | F25B 49/02 |
| 2018/0283718 | A1* | 10/2018 | Honda | F24F 11/77 |
| 2019/0017722 | A1* | 1/2019 | Suzuki | F24F 11/72 |
| 2019/0390877 | A1 | 12/2019 | Sakae et al. | |

FOREIGN PATENT DOCUMENTS

| | | | | |
|---|---|---|---|---|
| EP | 0936417 | A2 | 8/1999 | |
| EP | 1083392 | A2 | 3/2001 | |
| EP | 1083392 | A3 | 10/2002 | |
| EP | 1473524 | A2 * | 11/2004 | F24F 11/30 |
| EP | 2816295 | A2 | 12/2014 | |
| EP | 2955454 | A2 | 12/2015 | |
| JP | H07159010 | A | 6/1995 | |
| JP | 2017-053509 | A | 3/2017 | |
| JP | 2019-113258 | A | 7/2019 | |
| WO | WO-2013/038704 | A1 | 3/2013 | |
| WO | WO-2018154652 | A1 | 8/2018 | |
| WO | WO-2018220810 | A1 | 12/2018 | |

* cited by examiner

METHOD AND APPARATUS FOR RISK REDUCTION DURING REFRIGERANT LEAK

TECHNICAL FIELD

The present invention relates generally to heating, ventilation, and air conditioning (HVAC) systems and, more particularly, but not by way of limitation, to a method of and system for detecting refrigerant leak and modifying operation of the HVAC system to reduce the risk of a fire hazard due to refrigerant entering an enclosed space.

History of Related Art

HVAC systems are used to regulate environmental conditions within an enclosed space. Typically, HVAC systems have a circulation fan that pulls air from the enclosed space through ducts and pushes the air back into the enclosed space through additional ducts after conditioning the air (e.g., heating, cooling, humidifying, or dehumidifying the air).

SUMMARY

A method of monitoring a refrigerant leak. The method includes monitoring, by a first controller, operation of a first HVAC system for conditioning air within a first level of a residence, monitoring, by a second controller, operation of a second HVAC system for conditioning air within a second level of the residence and determining, using a plurality of leak detectors, whether refrigerant within the first HVAC system is leaking. Responsive to a positive determination in the determining step, receiving, by the first controller, a refrigerant leak warning signal, forwarding, by the first controller to the second controller, the refrigerant leak warning signal. Responsive to receiving the refrigerant leak warning signal from the first controller, activating, by the second controller, a variable-speed circulation fan of the second HVAC system.

A system includes a first HVAC system for conditioning air within a first level of a residence, a second HVAC system for conditioning air within a second level of the residence and a first plurality of leak detectors associated with at least one component of the first HVAC system. The system further includes a second plurality of leak detectors associated with at least one component of the second HVAC system, a first controller configured to communicate with the first plurality of leak detectors and a second controller configured to communicate with the second plurality of leak detectors. The first plurality of leak detectors are configured to determine whether refrigerant within the first HVAC system is leaking. Responsive to a positive determination, forward to the first controller, a refrigerant leak warning signal. Upon receiving the refrigerant leak warning signal, the first controller forwards the refrigerant leak warning signal to the second controller, wherein the second controller activates a variable-speed circulation fan of the second HVAC system even though refrigerant leak was detected in the first HVAC system.

A method of monitoring a plurality of HVAC systems for refrigerant leak. The method includes monitoring operation of the plurality of HVAC systems, wherein the plurality of HVAC systems comprise a first HVAC system comprising a first controller for conditioning air within a first level of a residence and a second HVAC system comprising a second controller for conditioning air within a second level of the residence. The method further includes determining, using a plurality of leak detectors, whether refrigerant within a first HVAC system is leaking. Responsive to a positive determination in the determining step, receiving, by the first controller, a refrigerant leak warning signal and forwarding, by the first controller to the second controller, the refrigerant leak warning signal. Responsive to receiving the refrigerant leak warning signal from the first controller, activating, by the second controller, a variable-speed circulation fan of the second HVAC system, activating a plurality of ceiling fans, activating a plurality of exhaust fans and forwarding a refrigerant leak warning signal to a plurality of smoke detectors to notify users of the refrigerant leak.

BRIEF DESCRIPTION OF THE DRAWINGS

A more complete understanding of embodiments of the present invention may be obtained by reference to the following Detailed Description when taken in conjunction with the accompanying Drawings wherein.

DETAILED DESCRIPTION

Figure 1A:
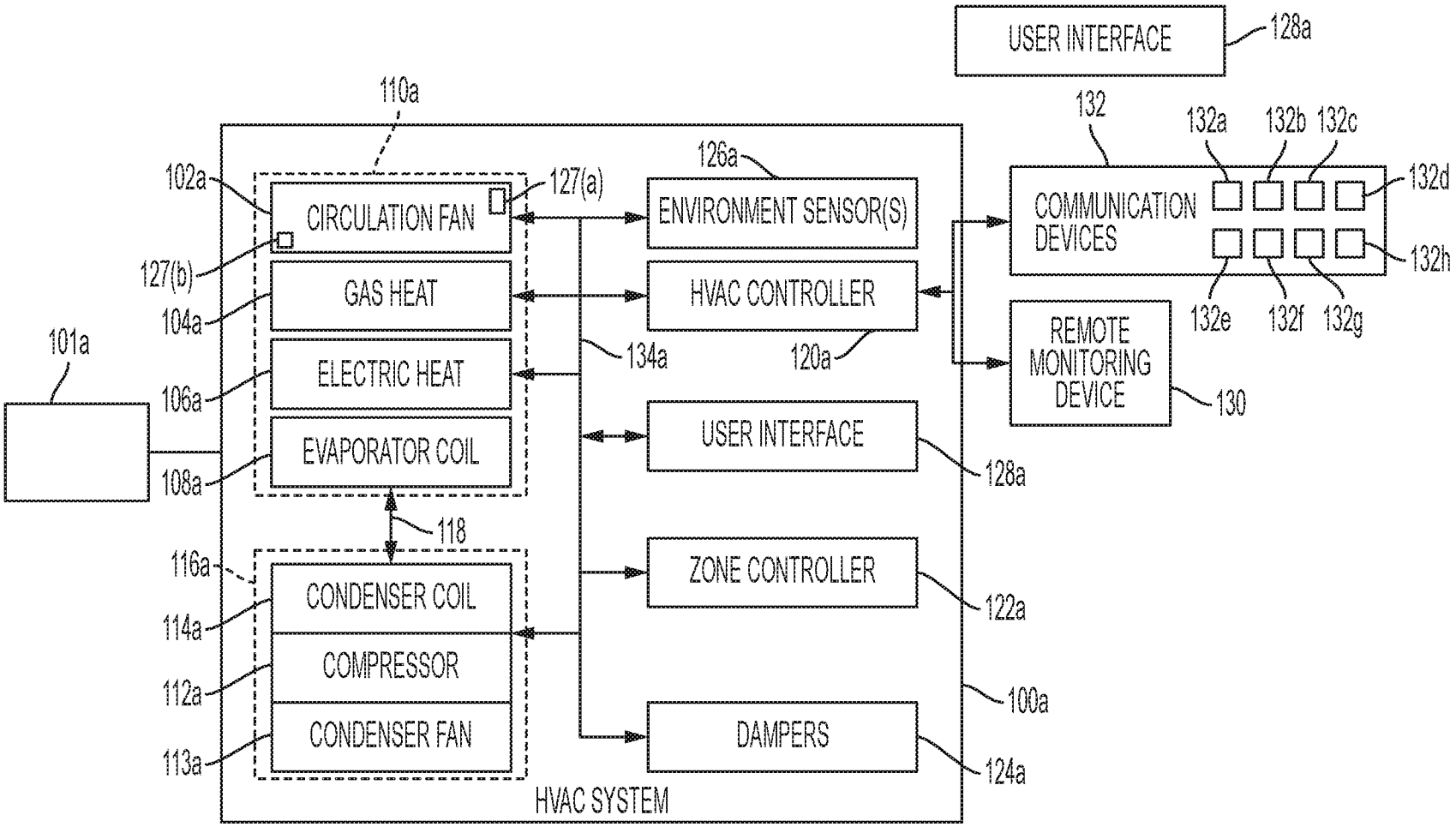
FIG. 1A is a block diagram of an illustrative HVAC system.

FIG. 1A illustrates an HVAC system 100*a*. In a typical embodiment, the HVAC system 100*a* is a networked HVAC system configured to condition air via, for example, heating, cooling, humidifying, or dehumidifying. The HVAC system 100*a* is a residential system for conditioning air for a section of a residence such as, for example, a first level of the residence. For illustration, the HVAC system 100*a* as illustrated in FIG. 1A includes various components; however, in other embodiments, the HVAC system 100*a* may include additional components that are not illustrated but typically included within HVAC systems. The HVAC system 100*a* can be a residential system or a commercial system such as, for example, a roof top system.

The HVAC system 100*a* includes a variable-speed circulation fan 102*a*, a gas heat 104*a*, electric heat 106*a* typically associated with the variable-speed circulation fan 102*a*, and a refrigerant evaporator coil 108*a*, also typically associated with the variable-speed circulation fan 102*a*. For illustrative purposes, only variable-speed circulation fan 102*a* is disclosed; however, in other embodiments, fixed speed and multi-speed circulation fans may be used as required. The variable-speed circulation fan 102*a*, the gas heat 104*a*, the electric heat 106*a*, and the refrigerant evaporator coil 108*a* are collectively referred to as an "indoor unit" 110*a*. In a typical embodiment, the indoor unit 110*a* is located within, or in close proximity to, an enclosed space 101*a* of a first level of a residence. The HVAC system 100*a* also includes a variable-speed compressor 112*a*, an associated condenser coil 114*a*, and a condenser fan 113*a*, which are typically referred to as an "outdoor unit" 116*a*. In a typical embodiment, the condenser fan 113*a* may be at least one of a fixed-speed condenser fan, a multi-speed condenser fan, and a variable-speed condenser fan. In various embodiments, the outdoor unit 116*a* is, for example, a rooftop unit or a ground-level unit. The variable-speed compressor 112*a* and the associated condenser coil 114*a* are connected to an associated evaporator coil 108*a* by a refrigerant line 118*a*. In a typical embodiment, the variable-speed compressor 112*a* is, for example, a single-stage compressor, a multi-stage compressor, a single-speed compressor, or a variable-speed compressor. The variable-speed circulation fan 102*a*, sometimes referred to as an air blower, is configured to operate at different capacities (i.e., variable motor speeds) to circulate air through the HVAC system 100*a*, whereby the circulated air is conditioned and supplied to the enclosed space 101*a*. For illustrative purposes, only variable-speed compressor 112*a* is disclosed; however, in other embodiments, fixed speed and multi-stage compressors may be used as required.

Still referring to FIG. 1A, the HVAC system 100*a* includes an HVAC controller 120*a* that is configured to control operation of the various components of the HVAC system 100*a* such as, for example, the variable-speed circulation fan 102*a*, the gas heat 104*a*, the electric heat 106*a*, the variable-speed compressor 112*a*, and the condenser fan 113*a*. In some embodiments, the HVAC system 100*a* can be a zoned system. In such embodiments, the HVAC system 100*a* includes a zone controller 122*a*, dampers 124*a*, and a plurality of environment sensors 126*a*. In a typical embodiment, the HVAC controller 120*a* cooperates with the zone controller 122*a* and the dampers 124*a* to regulate the environment of the enclosed space 101*a*.

The HVAC controller 120*a* may be an integrated controller or a distributed controller that directs operation of the HVAC system 100*a*. In a typical embodiment, the HVAC controller 120*a* includes an interface to receive, for example, thermostat calls, component health data, temperature setpoints, air blower control signals, environmental conditions, and operating mode status for various zones of the HVAC system 100*a*. In a typical embodiment, the HVAC controller 120*a* also includes a processor and a memory to direct operation of the HVAC system 100*a* including, for example, a speed of the variable-speed circulation fan 102*a*.

Still referring to FIG. 1A, in some embodiments, the plurality of environment sensors 126*a* are associated with the HVAC controller 120*a* and also optionally associated with a user interface 128*a*. In some embodiments, the user interface 128*a* provides additional functions such as, for example, operational, diagnostic, status message display, and a visual interface that allows at least one of an installer, a user, a support entity, and a service provider to perform actions with respect to the HVAC system 100*a*. In some embodiments, the user interface 128*a* is, for example, a thermostat of the HVAC system 100*a*. In other embodiments, the user interface 128*a* is associated with at least one sensor of the plurality of environment sensors 126*a* to determine the environmental condition information and communicate that information to the user. The user interface 128*a* may also include a display, buttons, a microphone, a speaker, or other components to communicate with the user. Additionally, the user interface 128*a* may include a processor and memory that is configured to receive user-determined parameters, and calculate operational parameters of the HVAC system 100*a* as disclosed herein.

In a typical embodiment, the HVAC system 100*a* is configured to communicate with a plurality of devices such as, for example, a monitoring device 130, communication devices 132, and the like. In a typical embodiment, the monitoring device 130 is not part of the HVAC system 100*a*. For example, the monitoring device 130 is a server or computer of a third party such as, for example, a manufacturer, a support entity, a service provider, and the like. In other embodiments, the monitoring device 130 is located at an office of, for example, the manufacturer, the support entity, the service provider, and the like.

In a typical embodiment, the communication devices 132 are non-HVAC devices having a primary function that is not associated with HVAC systems. In some embodiments, non-HVAC devices include mobile-computing devices that are configured to interact with the HVAC system 100*a* to monitor and modify at least some of the operating parameters of the HVAC system 100*a*. Mobile computing devices may be, for example, a personal computer (e.g., desktop or laptop), a tablet computer, a mobile device (e.g., smart phone), and the like. In other embodiments, non-HVAC devices include devices that are configured to interact with the HVAC system 100*a* such that their operation can be controlled by the HVAC system 100*a*. According to exemplary embodiments, the non-HVAC devices may be devices whose operation can be controlled via the controller 120*a* of the HVAC system 100*a* such as, for example, ceiling fans 132*a*, 132*b*, 132*c*, exhaust fans 132*d*, 132*e*, 132*f*, smoke detectors 132*g*, 132*h*, and the like. In a typical embodiment, the communications devices 132 such as, for example, the ceiling fans 132*a*, 132*b*, 132*c*, the exhaust fans 132*d*, 132*e*, 132*f*, and the smoke detectors 132*g*, 132*h* are configured to communicate with the HVAC controller 120*a*. In some embodiments, the data bus 134*a* may couple the HVAC controller 120*a* to the communication devices 132. For example, a wireless connection is employed to provide at least some of the connections between the HVAC controller 120*a* and the communication devices 132. In a typical embodiment, the communication devices 132 include at least one processor, memory and a user interface, such as a display. One skilled in the art will also understand that the communication devices 132 disclosed herein include other components that are typically included in such devices including, for example, a power supply, a communications interface, and the like.

The zone controller 122*a* is configured to manage movement of conditioned air to designated zones of the enclosed space. Each of the designated zones include at least one conditioning or demand unit such as, for example, the gas heat 104*a* and at least one user interface 128*a* such as, for example, the thermostat. The zone-controlled HVAC system 100*a* allows the user to independently control the temperature in the designated zones. In a typical embodiment, the zone controller 122*a* operates electronic dampers 124*a* to control air flow to the zones of the enclosed space.

In some embodiments, a data bus 134*a*, which in the illustrated embodiment is a serial bus, couples various components of the HVAC system 100*a* together such that data is communicated therebetween. In a typical embodiment, the data bus 134*a* may include, for example, any combination of hardware, software embedded in a computer readable medium, or encoded logic incorporated in hardware or otherwise stored (e.g., firmware) to couple components of the HVAC system 100*a* to each other. As an example and not by way of limitation, the data bus 134*a* may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus 134*a* may include any number, type, or configuration of data buses 134*a*, where appropriate. In particular embodiments, one or more data buses 134*a* (which may each include an address bus and a data bus) may couple the HVAC controller 120*a* to other components of the HVAC system 100*a*. In other embodiments, connections between various components of the HVAC system 100*a* are wired. For example, conventional cable and contacts may be used to couple the HVAC controller 120*a* to the various components. In some embodiments, a wireless connection is employed to provide at least some of the connections between components of the HVAC system 100*a* such as, for example, a connection between the HVAC controller 120*a* and the variable-speed circulation fan 102*a* or the plurality of environment sensors 126*a*.

Figure 1B:
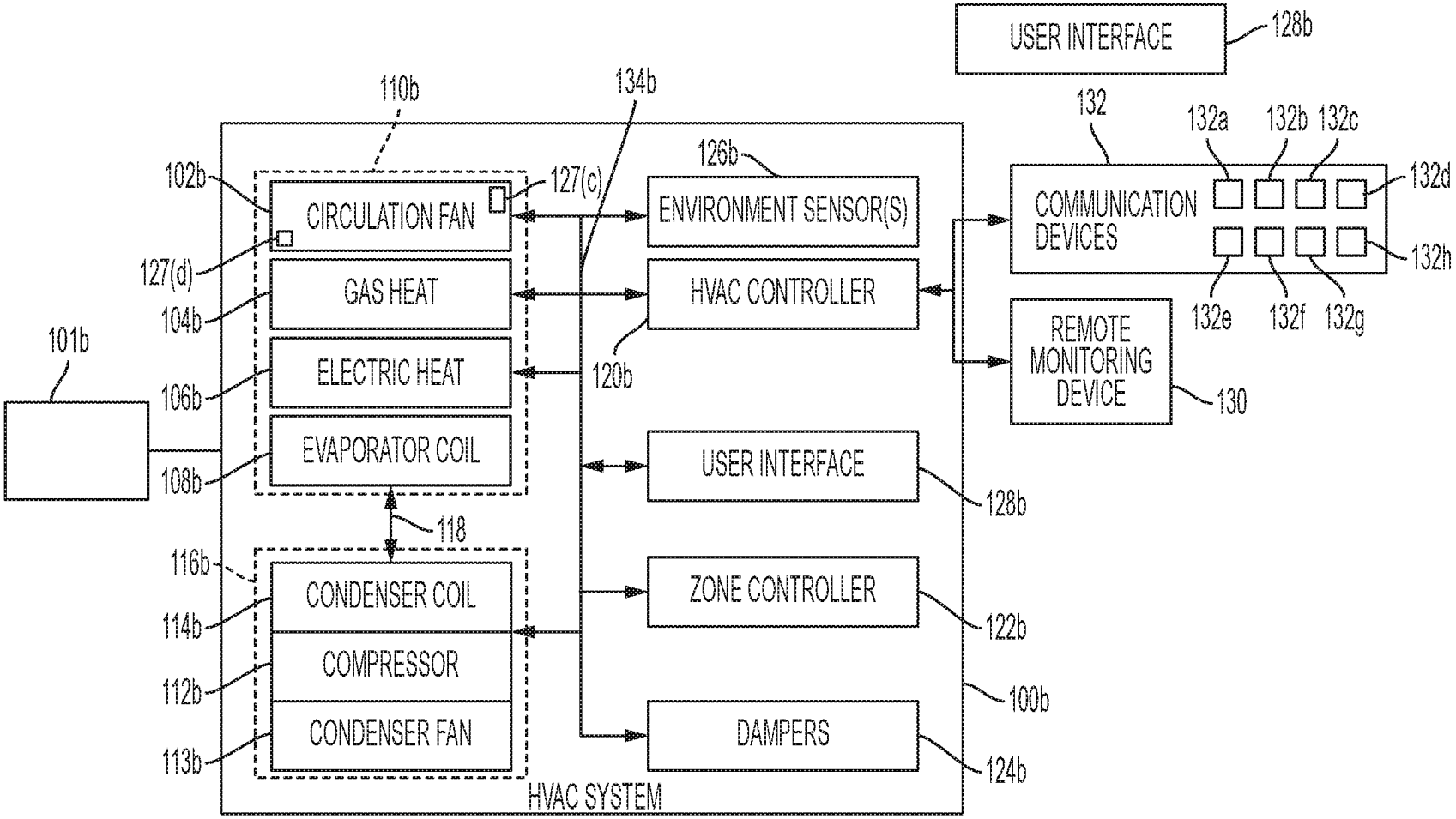
FIG. 1B is a block diagram of an illustrative HVAC system.

FIG. 1B illustrates an HVAC system 100*b*. In a typical embodiment, the HVAC system 100*b* is a networked HVAC system configured to condition air via, for example, heating, cooling, humidifying, or dehumidifying. The HVAC system 100*b* is a residential system for conditioning air for a section of a residence such as, for example, a second level of the residence. For illustration, the HVAC system 100*b* as illustrated in FIG. 1B includes various components; however, in other embodiments, the HVAC system 100*b* may include additional components that are not illustrated but typically included within HVAC systems. The HVAC system 100*b* can be a residential system or a commercial system such as, for example, a roof top system.

The HVAC system 100*b* includes a variable-speed circulation fan 102*b*, a gas heat 104*b*, electric heat 106*b* typically associated with the variable-speed circulation fan 102*b*, and a refrigerant evaporator coil 108*b*, also typically associated with the variable-speed circulation fan 102*b*. For illustrative purposes, only variable-speed circulation fan 102*b* is disclosed; however, in other embodiments, fixed speed and multi-speed circulation fans may be used as required. The variable-speed circulation fan 102*b*, the gas heat 104*b*, the electric heat 106*b*, and the refrigerant evaporator coil 108*b* are collectively referred to as an "indoor unit" 110*b*. In a typical embodiment, the indoor unit 110*b* is located within, or in close proximity to, an enclosed space 101*b* of a second level of a residence. The HVAC system 100*b* also includes a variable-speed compressor 112*b*, an associated condenser coil 114*b*, and a condenser fan 113*b*, which are typically referred to as an "outdoor unit" 116*b*. In a typical embodiment, the condenser fan 113*b* may be at least one of a fixed-speed condenser fan, a multi-speed condenser fan, and a variable-speed condenser fan. In various embodiments, the outdoor unit 116*b* is, for example, a rooftop unit or a ground-level unit. The variable-speed compressor 112*b* and the associated condenser coil 114*b* are connected to an associated evaporator coil 108*b* by a refrigerant line 118*b*. In a typical embodiment, the variable-speed compressor 112*b* is, for example, a single-stage compressor, a multi-stage compressor, a single-speed compressor, or a variable-speed compressor. The variable-speed circulation fan 102*b*, sometimes referred to as an air blower, is configured to operate at different capacities (i.e., variable motor speeds) to circulate air through the HVAC system 100*b*, whereby the circulated air is conditioned and supplied to the enclosed space 101*b*. For illustrative purposes, only variable-speed compressor 112*b* is disclosed; however, in other embodiments, fixed speed and multi-stage compressors may be used as required.

Still referring to FIG. 1B, the HVAC system 100*b* includes an HVAC controller 120*b* that is configured to control operation of the various components of the HVAC system 100*b* such as, for example, the variable-speed circulation fan 102*b*, the gas heat 104*b*, the electric heat 106*b*, the variable-speed compressor 112*b*, and the condenser fan 113*b*. In some embodiments, the HVAC system 100*b* can be a zoned system. In such embodiments, the HVAC system 100*b* includes a zone controller 122*b*, dampers 124*b*, and a plurality of environment sensors 126*b*. In a typical embodiment, the HVAC controller 120*b* cooperates with the zone controller 122*b* and the dampers 124*b* to regulate the environment of the enclosed space 101*b*.

The HVAC controller 120*b* may be an integrated controller or a distributed controller that directs operation of the HVAC system 100*b*. In a typical embodiment, the HVAC controller 120*b* includes an interface to receive, for example, thermostat calls, component health data, temperature setpoints, air blower control signals, environmental conditions, and operating mode status for various zones of the HVAC system 100*b*. In a typical embodiment, the HVAC controller 120*b* also includes a processor and a memory to direct operation of the HVAC system 100*b* including, for example, a speed of the variable-speed circulation fan 102*b*.

Still referring to FIG. 1B, in some embodiments, the plurality of environment sensors 126*b* are associated with the HVAC controller 120*b* and also optionally associated with a user interface 128*b*. The user interface 128*b*, the zone controller 122*b* and the data bus 134*b* are similar in design and construction with the user interface 128*a*, the zone controller 122*a* and the data bus 134*a* disclosed above relative to FIG. 1A.

In a typical embodiment, the HVAC system 100*b* is configured to communicate with a plurality of devices such as, for example, a monitoring device 130, communication devices 132, and the like. In a typical embodiment, the monitoring device 130 is not part of the HVAC system 100*b*. For example, the monitoring device 130 is a server or computer of a third party such as, for example, a manufacturer, a support entity, a service provider, and the like. In other embodiments, the monitoring device 130 is located at an office of, for example, the manufacturer, the support entity, the service provider, and the like.

In a typical embodiment, the communication devices 132 are non-HVAC device having a primary function that is not associated with HVAC systems. In some embodiments, non-HVAC devices include mobile-computing devices that are configured to interact with the HVAC system 100*b* to monitor and modify at least some of the operating parameters of the HVAC system 100*b*. Mobile computing devices may be, for example, a personal computer (e.g., desktop or laptop), a tablet computer, a mobile device (e.g., smart phone), and the like. In other embodiments, non-HVAC devices include devices that are configured to interact with the HVAC system 100*b* such that their operation can be controlled by the HVAC system 100*b*. According to exemplary embodiments, the non-HVAC devices may be ceiling fans 132*a*, 132*b*, 132*c*, exhaust fans 132*d*, 132*e*, 132*f*, smoke detectors 132*g*, 132*h*, and the like whose operation can be controlled via the controller 120*b* of the HVAC system 100*b*. In a typical embodiment, the communication devices 132 such as, for example, the ceiling fans 132*a*, 132*b*, 132*c*, the exhaust fans 132*d*, 132*e*, 132*f*, and the smoke detectors 132*g*, 132*h* are configured to communicate with the HVAC controller 120*b*. In some embodiments, the data bus 134*b* may couple the HVAC controller 120*b* to the communication devices 132. For example, a wireless connection is employed to provide at least some of the connections between the HVAC controller 120*b* and the communication devices 132. In a typical embodiment, the communication devices 132 include at least one processor, memory and a user interface, such as a display. One skilled in the art will also understand that the communication devices 132 disclosed herein include other components that are typically included in such devices including, for example, a power supply, a communications interface, and the like. For illustrative purposes, only two HVAC systems 100*a*, 100*b* are disclosed for conditioning air for various sections of the residence; however, in other embodiments, the any number of HVAC systems can be employed for conditioning air for the residence as dictated by design requirements.

Leak detection systems for the detection and monitoring of refrigerants are well known. Typically, the leak detection systems include a gas refrigerant detector, a monitor, and relay system to alert individuals and remote monitoring stations that a problem exists relative to refrigerant leak. Still referring to FIGS. 1A-1B, presently, in an event of refrigerant leak in the HVAC systems 100*a*, 100*b*, only the variable-speed circulation fan 102*a*, 102*b* of the HVAC system 100*a*, 100*b* in which leak is detected continues to operate. Refrigerant leak resulting in the refrigerant entering the enclosed space 101*a*, 101*b* is a health hazard. Additionally, in the case of flammable refrigerants, refrigerant entering the enclosed space 101*a*, 101*b* is a substantial fire hazard. What is needed is a method of and system for detecting refrigerant leak and modifying operation of certain components such as, for example, the variable-speed circulation fan 102*a*, 102*b* of all the HVAC systems 100*a*, 100*b* irrespective of which HVAC systems 100*a*, 100*b* had the refrigerant leak. In addition, operation of the communication devices 132 such as, for example, the ceiling fans 132*a*, 132*b*, 132*c*, the exhaust fans 132*d*, 132*e*, 132*f*, and the smoke detectors 132*g*, 132*h* is also modified to reduce the risk of a fire. In an effort to monitor refrigerant leak within HVAC systems and prevent health and fire hazard situations, exemplary embodiments disclose placing a plurality of leak detectors at various components of the HVAC system 100*a*, 100*b*. In a typical embodiment, a plurality of leak detectors may be placed around, for example, the variable-speed circulation fan 102*a*, 102*b*. In the context of the present application, a leak detector is defined as a device that detects refrigerant leak.

The exemplary HVAC system 100*a* includes a plurality of leak detectors 127*a*, 127*b* that are positioned on various components of the HVAC system 100*a*. The exemplary HVAC system 100*b* includes a plurality of leak detectors 127*c*, 127*d* that are positioned on various components of the HVAC system 100*b*. In particular, the plurality of leak detectors 127*a*, 127*b* are positioned around the variable-speed circulation fan 102*a* and the plurality of leak detectors 127*c*, 127*d* are positioned around the variable-speed circulation fan 102*b*. For illustrative purposes, only two leak detectors 127(*a*), 127(*b*) are disclosed as being positioned around the variable-speed circulation fan 102*a* and only two leak detectors 127(*c*), 127(*d*) are disclosed as being positioned around the variable-speed circulation fan 102*b*; however, in alternative embodiments, additional leak detectors may be positioned on other components as dictated by design requirements. For exemplary purposes, the operation of the plurality of leak detectors 127*a*, 127*b* illustrated in FIG. 1A will be described in detail; however, the plurality of leak detectors 127*c*, 127*d* illustrated in FIG. 1B operate in similar fashion as disclosed below relative to operation of the plurality of leak detectors 127*a*, 127*b* of FIG. 1A.

In a typical embodiment, the plurality of leak detectors 127*a*, 127*b* are configured to detect refrigerant leak within the HVAC system 100*a*. In a typical embodiment, plurality of leak detectors 127*a*, 127*b* are electronic leak detectors such as, for example, corona discharge leak detectors, heated diode leak detectors, ultrasonic leak detectors, and the like. In a typical embodiment, the plurality of leak detectors 127*a*, 127*b* are configured to communicate with the HVAC controller 120*a*. In particular, upon refrigerant leak detection, the plurality of leak detectors 127*a*, 127*b* communicate a refrigerant leak warning signal to the HVAC controller 120*a*. In some embodiments, the data bus 134*a* may couple the HVAC controller 120*a* to the plurality of leak detectors 127*a*, 127*b*. In other embodiments, connections between the HVAC controller 120*a* and the plurality of leak detectors 127*a*, 127*b* are wired. For example, conventional cable and contacts may be used to couple the HVAC controller 120*a* to the plurality of leak detectors 127*a*, 127*b*. In some embodiments, a wireless connection is employed to provide at least some of the connections between the HVAC controller 120*a* and the plurality of leak detectors 127*a*, 127*b*.

In a typical embodiment, during operation of the HVAC system 100*a*, the plurality of leak detectors 127*a*, 127*b* are configured to continuously monitor the HVAC system 100*a* for refrigerant leak. Upon detection of the refrigerant leak, the plurality of leak detectors 127*a*, 127*b* communicate the refrigerant leak warning signal to the HVAC controller 120*a*. Subsequently, the HVAC controller 120*a* notifies the HVAC controller 120*b* of the refrigerant leak. In addition, the HVAC controller 120*a* modifies operation of the communication devices 132 such as, for example, the ceiling fans 132*a*, 132*b*, 132*c*, the exhaust fans 132*d*, 132*e*, 132*f*, and the smoke detectors 132*g*, 132*h* to reduce the risk of a fire hazard.

In one embodiment, the HVAC controller 120*a* notifies the HVAC controller 120*b* of the refrigerant leak in the HVAC system 100*a*. After receiving the notification from the HVAC controller 120*a* of the refrigerant leak in the HVAC system 100*a*, the HVAC controller 120*b* activates the variable-speed circulation fan 102*b* of the HVAC system 100*b* even though refrigerant leak was detected in the HVAC system 100*a*. In some embodiments, in addition to notifying the HVAC controller 120*b* of the refrigerant leak such that the HVAC controller 120*b* activates the variable-speed circulation fan 102*b*, the controller 120*a* activates the ceiling fans 132*a*, 132*b*, 132*c* and the exhaust fans 132*d*, 132*e*, 132*f* to disperse the refrigerant from the enclosed space 101*a*. In some embodiments, the controller 120*a* forwards a refrigerant leak warning signal to the user interface 128*a* of the HVAC system 100*a* to notify users of the refrigerant leak. In alternate embodiments, the controller 120*a* forwards the refrigerant leak warning signal to the smoke detectors 132*g*, 132*h* to notify users of a refrigerant leak.

In some embodiments, in addition to notifying the HVAC controller 120*b* of the refrigerant leak such that the HVAC controller 120*b* activates the variable-speed circulation fan 102*b*, activating the ceiling fans 132*a*, 132*b*, 132*c* and the exhaust fans 132*d*, 132*e*, 132*f*, the HVAC controller 120*a* forwards the refrigerant leak warning signal to the monitoring device 130. In a typical embodiment, the monitoring device 130 is not part of the HVAC system. For example, the monitoring device 130 is a server or computer of the third party such as, for example, the manufacturer, the support entity, the service provider, and the like. In other embodiments, the monitoring device 130 is located at an office of, for example, the manufacturer, the support entity, the service provider, and the like.

Figure 2:
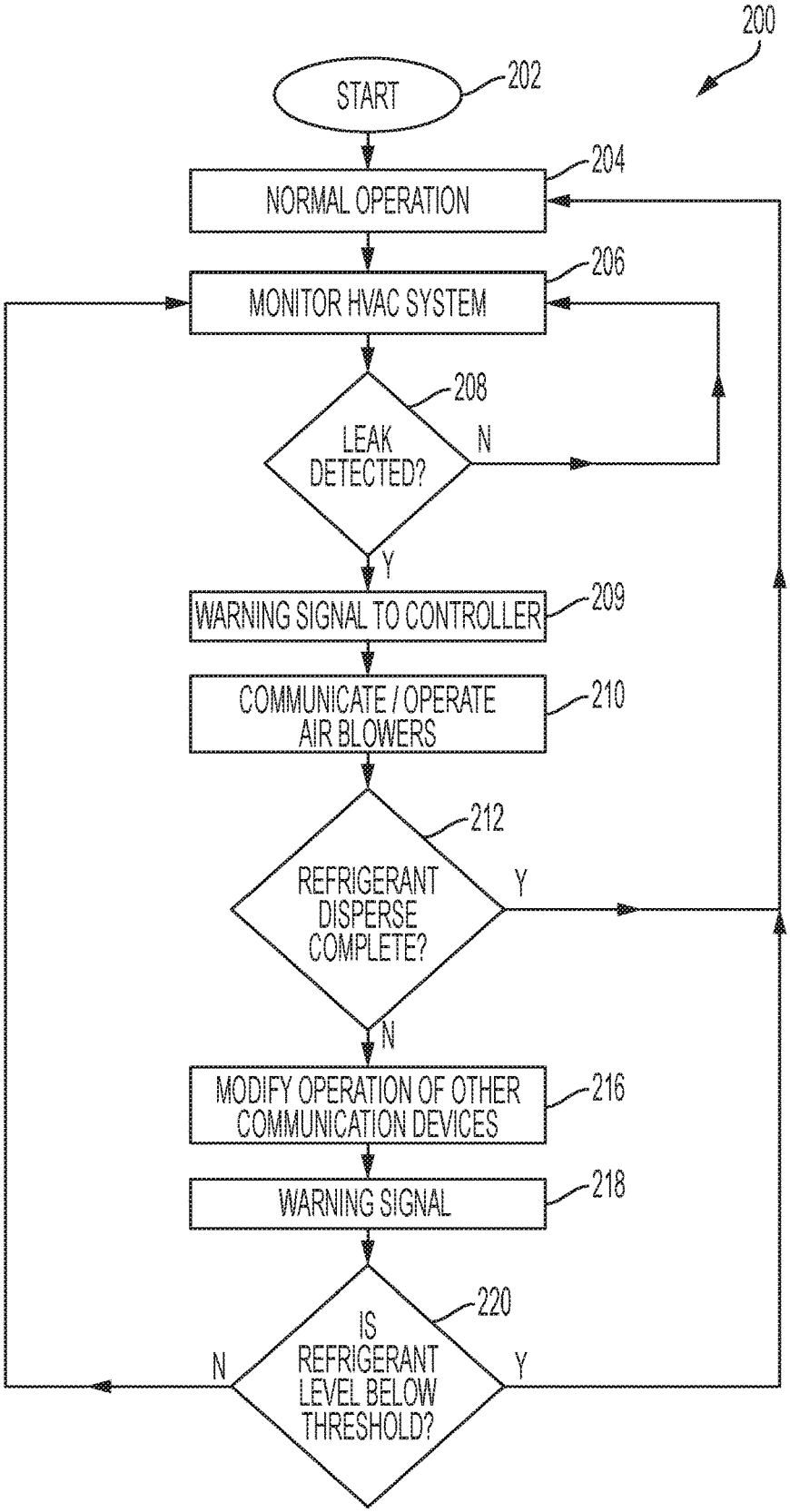
FIG. 2 is a flow diagram illustrating a process to monitor the HVAC systems for refrigerant leak and reduce the risk of a fire hazard.

FIG. 2 is a flow diagram illustrating a process 200 to monitor the HVAC system for refrigerant leak and reduce the risk of a fire hazard. For illustrative purposes, the process 200 will be described herein relative to the HVAC system 100*a* of FIG. 1A; however, it should be noted that the process 200 can be performed to monitor refrigerant leak in the HVAC system 100*b* of FIG. 1B. The process 200 starts at step 202. At step 204, the HVAC system 100*a* performs normal operation to condition air via, for example, heating, cooling, humidifying, or dehumidifying. At step 206, the HVAC controller 120*a* monitors operation of the HVAC system 100*a*. At step 208, it is determined whether refrigerant leak is detected. In a typical embodiment, the plurality of leak detectors 127*a*, 127*b* continuously monitor the HVAC system 100*a* for refrigerant leak. The plurality of leak detectors 127*a*, 127*b* are electronic leak detectors such as, for example, corona discharge leak detectors, heated diode leak detectors, ultrasonic leak detectors, and the like. If it is determined at step 208 that no refrigerant leak is detected, the process 200 returns to step 206. However, if it is determined at step 208 that refrigerant leak is detected, the process 200 proceeds to step 209. At step 209, upon detection of the refrigerant leak, the plurality of leak detectors 127*a*, 127*b* communicate the refrigerant leak warning signal to the HVAC controller 120*a*. Subsequently, at step 210, the HVAC controller 120*a* notifies the HVAC controller 120*b* (FIG. 1B) of the refrigerant leak in the HVAC system 100*a*. After receiving the notification from the HVAC controller 120*a* of the refrigerant leak in HVAC system 100*a*, the HVAC controller 120*b* activates the variable-speed circulation fan 102*b* of the HVAC system 100*b* even though refrigerant leak was detected in the HVAC system 100*a*. From step 210, the process 200 proceeds to step 212.

At step 212, it is determined whether the refrigerant has dispersed. If it is determined at step 212 that the refrigerant has dispersed, the process 200 returns to step 204. However, if it is determined at step 212 that the refrigerant has not dispersed, the process 200 proceeds to step 216. At step 216, the HVAC controller 120*a* modifies operation of the communication devices 132 such as, for example, the ceiling fans 132*a*, 132*b*, 132*c*, the exhaust fans 132*d*, 132*e*, 132*f*, and the smoke detectors 132*g*, 132*h* to reduce the risk of a fire hazard. In some embodiments, in addition notifying the HVAC controller 120*b* of the refrigerant leak such that the HVAC controller 120*b* activates the variable-speed circulation fan 102*b*, the controller 120*a* activates the ceiling fans 132*a*, 132*b*, 132*c* and the exhaust fans 132*d*, 132*e*, 132*f* to disperse the refrigerant. At step 218, in addition to notifying the HVAC controller 120*b* to activate the variable-speed circulation fan 102*b* due to refrigerant leak in the HVAC system 100*a*, activating the ceiling fans 132*a*, 132*b*, 132*c* and the exhaust fans 132*d*, 132*e*, 132*f*, the controller 120*a* forwards a refrigerant leak warning signal to the user interface 128*a* of the HVAC system 100*a* to notify users of a refrigerant leak. In alternate embodiments, the controller 120*a* forwards a refrigerant leak warning signal to the smoke detectors 132*g*, 132*h* to notify users of a refrigerant leak. At step 220, it is determined by the plurality of leak detectors 127*a*, 127*b* whether the refrigerant level is below a predetermined refrigerant threshold level. If it is determined at step 220 that the refrigerant level is not below the predetermined refrigerant threshold level, the process 200 returns to step 206. However, if it is determined at step 220 that the refrigerant level is below the predetermined refrigerant threshold level, the process 200 returns to step 204.

For purposes of this patent application, the term computer-readable storage medium encompasses one or more tangible computer-readable storage media possessing structures. As an example and not by way of limitation, a computer-readable storage medium may include a semiconductor-based or other integrated circuit (IC) (such as, for example, a field-programmable gate array (FPGA) or an application-specific IC (ASIC)), a hard disk, an HDD, a hybrid hard drive (HHD), an optical disc, an optical disc drive (ODD), a magneto-optical disc, a magneto-optical drive, a floppy disk, a floppy disk drive (FDD), magnetic tape, a holographic storage medium, a solid-state drive (SSD), a RAM-drive, a SECURE DIGITAL card, a SECURE DIGITAL drive, a flash memory card, a flash memory drive, or any other suitable tangible computer-readable storage medium or a combination of two or more of these, where appropriate.

Particular embodiments may include one or more computer-readable storage media implementing any suitable storage. In particular embodiments, a computer-readable storage medium implements one or more portions of the processor, one or more portions of the system memory, or a combination of these, where appropriate. In particular embodiments, a computer-readable storage medium implements RAM or ROM. In particular embodiments, a computer-readable storage medium implements volatile or persistent memory. In particular embodiments, one or more computer-readable storage media embody encoded software.

In this patent application, reference to encoded software may encompass one or more applications, bytecode, one or more computer programs, one or more executables, one or more instructions, logic, machine code, one or more scripts, or source code, and vice versa, where appropriate, that have been stored or encoded in a computer-readable storage medium. In particular embodiments, encoded software includes one or more application programming interfaces (APIs) stored or encoded in a computer-readable storage medium. Particular embodiments may use any suitable encoded software written or otherwise expressed in any suitable programming language or combination of programming languages stored or encoded in any suitable type or number of computer-readable storage media. In particular embodiments, encoded software may be expressed as source code or object code. In particular embodiments, encoded software is expressed in a higher-level programming language, such as, for example, C, Python, Java, or a suitable extension thereof. In particular embodiments, encoded software is expressed in a lower-level programming language, such as assembly language (or machine code). In particular embodiments, encoded software is expressed in JAVA. In particular embodiments, encoded software is expressed in Hyper Text Markup Language (HTML), Extensible Markup Language (XML), or other suitable markup language.

Depending on the embodiment, certain acts, events, or functions of any of the algorithms described herein can be performed in a different sequence, can be added, merged, or left out altogether (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. Although certain computer-implemented tasks are described as being performed by a particular entity, other embodiments are possible in which these tasks are performed by a different entity.

What is claimed is:

1. A method of monitoring a refrigerant leak, the method comprising:

monitoring, by a first controller, operation of a first heating, ventilation, and air conditioning (HVAC) system for conditioning air within a first level of a residence;

monitoring, by a second controller, operation of a second HVAC system for conditioning air within a second level of the residence;

determining, using a plurality of leak detectors, that refrigerant within the first HVAC system is leaking;

responsive to a determination that refrigerant within the first HVAC system is leaking, receiving, by the first controller, a refrigerant leak warning signal;

forwarding, by the first controller to the second controller, the refrigerant leak warning signal;

responsive to receiving the refrigerant leak warning signal from the first controller, activating, by the second controller, a variable-speed circulation fan of the second HVAC system;

determining that the leaked refrigerant has not dispersed after activating the variable-speed circulation fan of the second HVAC system; and responsive to the determination that the leaked refrigerant has not dispersed, activating a plurality of ceiling fans and a plurality of exhaust fans to disperse the leaked refrigerant.

2. The method of claim 1 further comprising:

responsive to a determination that refrigerant within the first HVAC system is not leaking, returning to the monitoring step.

3. The method of claim 1, further comprising:

responsive to a determination that the leaked refrigerant has dispersed, operating the first and second HVAC systems in a normal mode.

4. The method of claim 1, further comprising:

responsive to a determination that refrigerant within the first HVAC system is leaking, forwarding a refrigerant leak warning signal to a plurality of smoke detectors to notify users of the refrigerant leak.

5. The method of claim 1, wherein the plurality of leak detectors are positioned around a variable-speed circulation fan of the first HVAC system and the variable-speed circulation fan of the second HVAC system.

6. The method of claim 1, wherein the plurality of leak detectors comprises at least one of a corona discharge leak detector, a heated diode leak detector, and an ultrasonic leak detector.

7. The method of claim 1, wherein the first and second controllers are configured to communicate with the plurality of leak detectors wirelessly.

8. The method of claim 1, wherein the first and second controllers are configured to communicate with the plurality of leak detectors using a cable connection.

9. The method of claim 1 further comprising:

determining whether a refrigerant level is below a refrigerant threshold level;

responsive to a determination that the refrigerant level is below the refrigerant threshold level, returning to the monitoring step; and responsive to a determination that the refrigerant level is not below the refrigerant threshold level, operating the first and second HVAC systems in a normal mode.

10. A system comprising:

a first heating, ventilation, and air conditioning (HVAC) system for conditioning air within a first level of a residence;

a second HVAC system for conditioning air within a second level of the residence;

a first plurality of leak detectors associated with at least one component of the first HVAC system;

a second plurality of leak detectors associated with at least one component of the second HVAC system;

a first controller configured to communicate with the first plurality of leak detectors;

a second controller configured to communicate with the second plurality of leak detectors;

wherein the first plurality of leak detectors are configured to:

determine whether refrigerant within the first HVAC system is leaking;

responsive to a determination that refrigerant within the first HVAC system is leaking, forward to the first controller a refrigerant leak warning signal;

upon receiving the refrigerant leak warning signal, the first controller forwards the refrigerant leak warning signal to the second controller, wherein the second controller activates a variable-speed circulation fan of the second HVAC system responsive to the refrigerant leak detected in the first HVAC system; wherein at least one of the first and second controllers is configured to:

determine whether the leaked refrigerant has dispersed after activating the variable-speed circulation fan of the second HVAC system; and responsive to a determination that the leaked refrigerant has not dispersed, activate a plurality of ceiling fans and a plurality of exhaust fans to disperse the leaked refrigerant.

11. The system of claim 10, wherein responsive to a determination that the leaked refrigerant has dispersed, operate the first and second HVAC systems in a normal mode.

12. The system of claim 11, wherein responsive to a determination that refrigerant within the first HVAC system is leaking, the first HVAC system causes the first controller to forward a refrigerant leak warning signal to a plurality of smoke detectors to notify users of the refrigerant leak.

13. The system of claim 10, wherein:

the first plurality of leak detectors are positioned around a variable-speed circulation fan of the first HVAC system; and the second plurality of leak detectors are positioned around the variable-speed circulation fan of the second HVAC system.

14. The system of claim 10, wherein the first and second plurality of leak detectors comprise at least one of a corona discharge leak detector, a heated diode leak detector, and an ultrasonic leak detector.

15. The system of claim 10, wherein the first controller is configured to communicate with the first plurality of leak detectors wirelessly.

16. The system of claim 10, wherein the first controller is configured to communicate with the first plurality of leak detectors using a cable connection.

17. A method of monitoring a plurality of heating, ventilation, and air conditioning (HVAC) systems for refrigerant leak, the method comprising:

monitoring operation of the plurality of HVAC systems, wherein the plurality of HVAC systems comprise a first HVAC system comprising a first controller for conditioning air within a first level of a residence and a second HVAC system comprising a second controller for conditioning air within a second level of the residence;

determining, using a plurality of leak detectors, that refrigerant within the first HVAC system is leaking;

responsive to a determination that refrigerant within the first HVAC system is leaking, receiving, by the first controller, a refrigerant leak warning signal;

forwarding, by the first controller to the second controller, the refrigerant leak warning signal;

responsive to receiving the refrigerant leak warning signal from the first controller, activating, by the second controller, a variable-speed circulation fan of the second HVAC system;

determining that the leaked refrigerant has not dispersed after activating the variable-speed circulation fan of the second HVAC system;

responsive to the determination that the leaked refrigerant has not dispersed, the first controller modifies operation of communication devices by:

activating a plurality of ceiling fans;

activating a plurality of exhaust fans; and forwarding a refrigerant leak warning signal to a plurality of smoke detectors to notify users of the refrigerant leak.

18. The method of claim 17, wherein the plurality of leak detectors are positioned around a variable-speed circulation fan of the first HVAC system and the variable-speed circulation fan of the second HVAC system.

19. The method of claim 17, wherein the plurality of leak detectors comprises at least one of a corona discharge leak detector, a heated diode leak detector, and an ultrasonic leak detector.

20. The method of claim 17, wherein the first and second controllers are configured to communicate with the plurality of leak detectors wirelessly.

* * * * *